US007367764B2

(12) United States Patent
Li et al.

(10) Patent No.: US 7,367,764 B2
(45) Date of Patent: May 6, 2008

(54) REVERSIBLE PLATE POSITIONING DEVICE FOR STATIONARY RADIATION IMAGING TRAILER SYSTEM

(75) Inventors: Ning Li, Beijing (CN); Kejun Kang, Beijing (CN); Haifeng Hu, Beijing (CN); Wanquan Shen, Beijing (CN); Jianjun Su, Beijing (CN); Zhongrong Yang, Beijing (CN); Qitian Miao, Beijing (CN); Jianmin Li, Beijing (CN)

(73) Assignees: Nuctech Company Limited, Beijing, P.R. (CN); Tsinghua University, Beijing, P.R. (CN)

( * ) Notice: Subject to any disclaimer, the term of this patent is extended or adjusted under 35 U.S.C. 154(b) by 0 days.

(21) Appl. No.: 11/594,818

(22) Filed: Nov. 9, 2006

(65) Prior Publication Data

US 2007/0126189 A1 Jun. 7, 2007

(30) Foreign Application Priority Data

Nov. 9, 2005 (CN) ..... 2005 1 0086815

(51) Int. Cl.
*B60P 7/00* (2006.01)

(52) U.S. Cl. ..... 410/65; 410/7; 410/19; 410/30; 410/46; 410/56; 410/67

(58) Field of Classification Search ..... 410/7, 410/19, 30, 46, 56–57, 65–67; 414/222.01
See application file for complete search history.

(56) References Cited

U.S. PATENT DOCUMENTS

| | | | |
|---|---|---|---|
| 6,837,657 | B2 | 1/2005 | Li et al. |
| 7,059,814 | B2 | 6/2006 | Su et al. |
| 2003/0017020 | A1* | 1/2003 | Sain ..... 410/56 |

FOREIGN PATENT DOCUMENTS

| | | |
|---|---|---|
| CN | 1500685 A | 6/2004 |
| CN | 1607122 A | 4/2005 |
| CN | 1607135 A | 4/2005 |

* cited by examiner

*Primary Examiner*—Stephen Gordon
(74) *Attorney, Agent, or Firm*—Jacobson Holman PLLC

(57) ABSTRACT

The present invention discloses a reversible plate positioning device for a stationary radiation imaging trailer system, comprising a left platform (7-1) and a right platform (7-2) that can be connected with a trailing part (4) of a trailer frame and ground locking part (12), the left platform (7-1) and right platform (7-2) provided with slopes (1) for the uploading of a vehicle to be detected respectively at the front ends and with positioning recesses (9) at the middle of an upper surface, each positioning recess (9) being provided with a wheel-locking device (2), wherein, each wheel-locking device (2) comprises of a pivotable crank plate (10) that is hinged to the positioning recess (9) and can rotates about the pivot axis thereof, a chain (15) connected with the crank plate (10), a pull-rod (14) connected with the chain (15), and a fixing sleeve (6) corresponding to the pull-rod (14), in which a spring (13) is provided in the fixing sleeve (6), and when the vehicle to be detected is located in the positioning recesses (9), each crank plate (10) rotates around the pivot axis thereof under the elastic force of the spring (13) so that the crank plate (10) is tilted at the front of each positioning recesses (9), and thus the wheels are locked in the positioning recesses (9), a carrier rod (5) biasing the spring (13) is respectively provided at the end of each fixing sleeves (6), when the trailer is arrived, the carrier rods (5) bias the springs (13) under external force, so that each crank plates (10) slacks under the function of the pull-rod (14). By the aforementioned device, the vehicle to be detected can be stably driven out of the trailer platforms, avoiding the impact to the vehicle to be detected and the trailer during downloading.

12 Claims, 2 Drawing Sheets

REVERSIBLE PLATE POSITIONING DEVICE FOR STATIONARY RADIATION IMAGING TRAILER SYSTEM

BACKGROUND OF THE INVENTION

1. Field of the Invention

The present invention relates to the technical field of trailer system, more particularly, to a reversible plate positioning device for a stationary radiation imaging trailer system.

2. Description of the Related Art

Stationary radiation imaging inspection system is commonly employed for Customs, civil airports and railway systems etc. Generally, the radiation imaging inspection system is provided with a stationary radiation source and an array detector for receiving rays that penetrate through a vehicle to be detected in a detection passage that can shield rays. A specific trailing device detects a vehicle carrying a container with ray beams. The rays penetrating through the container is transmitted to the detector which reflects density distribution of items in the container based on the variation of the ray intensity, and the ray intensity is transformed into image gray scale, thus obtaining the perspective images of the objects in the container.

In the prior art, the specific trailing device is generally configured to be a platform lorry or a plate-link-chain conveyer. For example, a 2000 series container/vehicle detection system manufactured by Rapiscan Inc. employs a platform lorry. The whole truck carrying the container is driven onto the platform lorry which carries the truck through the rays. However, the platform lorry occupies a large area and is at high cost. As the vehicle to be detected can not be reliably positioned and the operation of the system is not stable, high image quality can not be achieved. In addition, the vehicle to be detected can not easily be uploaded since the distance between the platform lorry and the floor is relatively large. And the polygon effect of plate-link-chain transmission degrades the quality of image, and the noise thereof is unbearable. Applicant's Chinese Patent No. 02148669.7 (Publication number CN1500685) entitled "trailer for automated scanning radiation inspecting system of large object" sought to overcome the aforementioned disadvantages of prior art. Based upon the aforementioned patent, the applicant filed Chinese Patent Application No. 200310100183.6 (Publication number CN1607122) entitled "trailer system for radiation imaging" and Chinese Patent Application No. 200310100184.0 (Publication number CN1607135) entitled "trailer of trailer system for radiation imaging" on Oct. 16, 2003 respectively. The trailer of the above inventions has the advantages of low noise, less occupancy area and low cost etc. respectively. Furthermore, the stability of operation of the system is enhanced, and the platform of the vehicle body is lowered for convenience of the upload of the vehicle to be detected. In addition, a wheel positioning and trailer body anchoring device is provided. However, the aforementioned techniques still have the following disadvantages:

When the vehicle to be detected is downloaded, all wheels except front ones of the vehicle would run over a crank plate with a normally lifted-up upper end face in a wheel-locking device. As a result, the trailer and the wheels of the vehicle to be detected both generates impact force during the unloading of the vehicle to be detected, resulting in instability of unloading operation of the vehicle to be detected.

SUMMARY OF THE INVENTION

The present invention has been made to overcome the above mentioned disadvantages. Accordingly, the present invention provides a reversible plate positioning device for a stationary radiation imaging trailer system, which makes modifications and improvements to the aforementioned patents and can avoid impact force to the trailer and the vehicle to be detected during downloading. Thus, the vehicle to be detected can be stably driven away from the trailer platform.

To achieve an aspect of the above-mentioned object, the present invention provides a reversible plate positioning device for a stationary radiation imaging trailer system, comprising a left platform and a right platform that can be connected with a trailing part of a trailer frame and a ground locking part, the left platform and right platform being provided at the front ends thereof with slopes for the uploading of a vehicle to be detected respectively and at the middle of an upper surface with positioning recesses, each positioning recess being provided with a wheel-locking device, wherein:

each wheel-locking device comprises:

a pivotable crank plate which is hinged to the positioning recess and can rotates about the pivot axis thereof;

a chain connected with the crank plate;

a pull-rod connected with the chain, and a fixing sleeve corresponding to the pull-rod, wherein:

a spring is provided in the fixing sleeve, and when the vehicle to be detected is located in the positioning recesses, each crank plate rotates around the pivot axis thereof due to the elastic force of the spring so that the crank plate is brought into a lifted-up state at the front portion of each positioning recesses, thereby the wheels are locked in the positioning recesses, a carrier rod capable of compressing the spring is respectively provided at the end of each fixing sleeves, and when the trailer is landed at a bank, the carrier rods compress the springs due to external force, so that each crank plates is brought into a slacked state due to the operation of the pull-rod.

According to an aspect of the present invention, preferably, each crank plate is hinged to a side plate of a rib plate at a bottom side end of each positioning recess so as to be rotatable around the pivot axis thereof.

According to an aspect of the present invention, preferably, each fixing sleeve is provided at the bottom parts of the left and right platforms at the rear ends of each positioning recess respectively.

According to an aspect of the present invention, preferably, each pull-rod is extended into each fixing sleeve respectively and is tightened by the spring provided in the fixing sleeve, so that each crank plate is brought into a lifted-up at the front part of each positioning recess.

According to an aspect of the present invention, preferably, each crank plate can rotates around the pivot axis thereof so that an upper end face of the crank plate can enters into the left and right platforms.

According to an aspect of the present invention, preferably, a rear part of each positioning recess is provided with a sloping plate for performing a cushion effect.

According to an aspect of the present invention, preferably, each positioning recess has a size that matches with that of the lower part of the wheels in the vehicle to be detected.

According to an aspect of the present invention, preferably, the upper end face of each crank plate is uniformly arranged with rivets for prevention of slipping.

By the aforementioned configuration of the present invention, after the front wheels of the vehicle to be detected is located in each positioning recess, an upper end face of each crank plate is tilted under the pushing force of the springs that withstands the rear lower part of the front wheels thereof, so that the vehicle to be detected would not back off. Additionally, the front wheels of the vehicle to be detected can be stably locked in the positioning recesses for the sloping plates blocking the vehicle front wheels. When the vehicle to be detected is downloaded from the trailer, and the trailer is landed, the carrier rod at the end of the fixing sleeve is stressed and biases the springs so that the pull-rod withdrawn and the crank plate slacks. The upper end face of the crank plate can wholly enters into the left and right platforms of the trailer and keeps level under the force of the wheels. Therefore, the vehicle to be detected can be stably driven out of the trailer platforms, avoiding the impact to the vehicle to be detected and the trailer.

According to another aspect of the present invention, the present invention provides a stationary radiation imaging trailer system, comprising aforementioned reversible plate positioning device.

According to another aspect of the present invention, the present invention provides a stationary radiation imaging inspection system, comprising the aforementioned stationary radiation imaging trailer system.

BRIEF DESCRIPTION OF THE DRAWINGS

The above and other objects, and features, and advantages of the preferred embodiments of the invention will be more apparent from the following description taken in conjunction with the accompanying drawings, in which.

DETAILED DESCRIPTION OF THE PREFERRED EMBODIMENT

Figure 1:
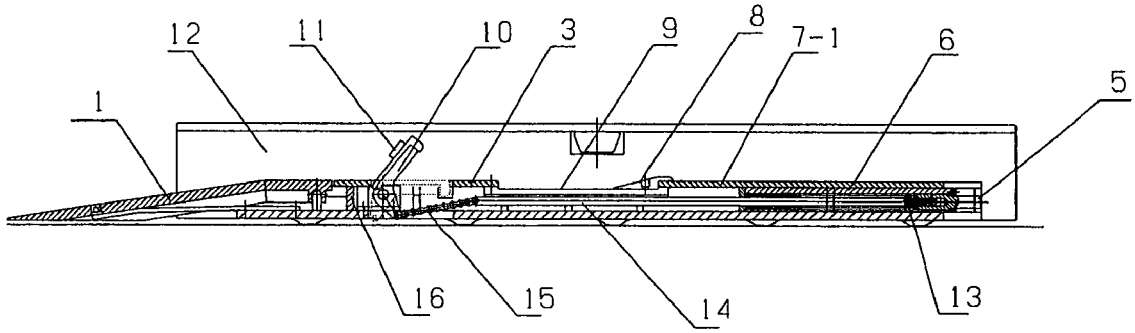
FIG. 1 is a structural sectional view according to the present invention.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 2:
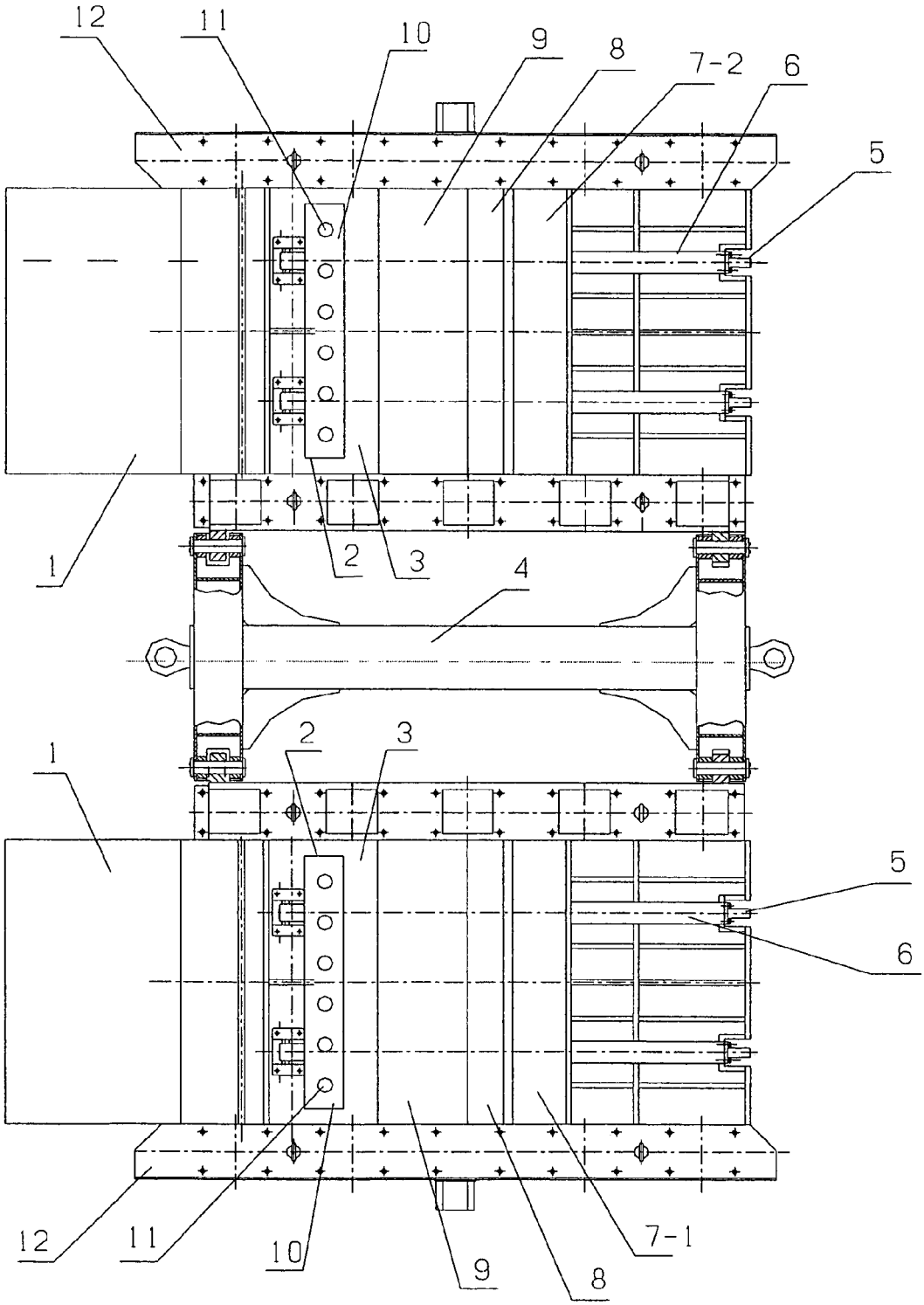
FIG. 2 is a schematic view showing the connection applied to the trailer system of the present invention

Referring to FIG. 1 and FIG. 2, the present invention comprises a left platform 7-1 and a right platform 7-2 that can be connected with a trailing part 4 of a trailer frame and a ground locking part 12, respectively, with the left platform 7-1 and right platform 7-2 having identical designs. The left platform 7-1 and right platform 7-2 are provided at the middle part on the upper plane thereof with positioning recesses 9 having sizes matching with those of the lower part of the vehicle wheels. The positioning recess 9 is provided at the rear part thereof (shown as the right end in FIG. 1) with a sloping plate 8 which performs a cushion effect for the wheels of the vehicle to be detected. The positioning recess 9 is provided at the front part thereof (shown as the left end in FIG. 1) with a wheel-locking device 2 which prevents the front wheels of the vehicle from slipping off the positioning recess during driving process of the trailer.

The front ends of the left platform 7-1 and right platform 7-2 are respectively connected with slopes 1 so that the vehicle to be detected can be stably driven onto it. Each wheel-locking device 2 comprises a crank plate 10 that can be pressed flat into a pressing plate 3 embedded in the left platform 7-1 and right platform 7-2 (as shown by the dotted line in FIG. 1), a chain 15 connected with the crank plate 10, a pull-rod 14 connected with the chain 15, and a fixing sleeve 6 corresponding to the pull-rod 14.

Each crank plate 10 is hinged to a side plate of a rib plate 16 at a bottom side end of each positioning recess 9 to be rotatable around a pivot axis thereof. The upper end face of each crank plate 10 is uniformly arranged with rivets 11 for prevention of slipping. Each fixing sleeve 6 is respectively provided at the bottom of the left platform 7-1 and right platform 7-2 along the rear end of the downstream end of each positioning recess 9 (the downstream direction of the vehicle moving direction is defined as the rear end of each positioning recess 9, i.e. the right end as shown in FIG. 1). Each pull-rod 14 is extended into each fixing sleeve 6 respectively and is tightened by the spring 13 provided in the fixing sleeve 6, so that each crank plate 10 pivots around a pivot axis thereof and is tilted at the front part of each positioning recess 9. A carrier rod 5 which can compress the spring 13 is respectively provided at the end of each fixing sleeve 6. When the front wheels of the vehicle to be detected press the crank plate 10 so that the crank plate 10 turns flat and enters into the positioning recesses 9, the upper end face of each crank plate 10 is restored into a lifted-up state. The front wheels preferably cooperate with the sloping plate 8 to lock the wheels in the positioning recesses 9. When the trailer is landed, for example, at a bank, the carrier rod 5 at the tip end of the fixing sleeve 6 is pressed, such as, by a block piece (not shown) mounted at an exit of the scanning passage, and the spring 13 is compressed so that the pull-rod 14 retreats backward, so that each crank plate 10 becomes into a slacked state.

While the present invention is applied to a trailer system, the operation modes of the trailing part 4 of the trailer frame and the ground locking part are well known for a person normally skilled in the prior arts, such as the Chinese patent No. 02148669.7, published on Jun. 2, 2004 (Publication number CN1500685) and the Chinese patent No. 200310100184.0 published on Apr. 20, 2005 (Publication number CN1607135). The disclosures of the above patent publications are incorporated hereby for reference.

When the vehicle to be detected is driven onto the left platform 7-1 and right platform 7-2 through the slopes 1 and the front wheels of the vehicle press the crank plates 10 into the pressing plates 3 and enter into the positioning recesses 9, the straining pull-rod 14 shifts rightward by the elastic restoring force of the spring 13 so that the crank plates 10 rotate in an anticlockwise direction around the pivot axis thereof to restore and maintain a lifted-up state. The crank plates 10 bear against the rear lower part of the front wheels of the vehicle so that the wheels will not retreat backward. With additional action of sloping plates 8 to the wheels, the wheels and the crank plates 10 are brought into tight contact with each other so that the advance of the front wheels of the vehicle to be detected or the swaying of the vehicle during the travel can be prevented.

When the trailer system is landed, the carrier rod 5 at the end of the wheel-locking device 2 comes to collide with and bear against a blocking piece (not shown) mounted at the exit of the scanning passage. After the carrier rod 5 is pressed, the compression spring 13 is compressed so that the pull-rod 14 retreats backward and the chain 15 becomes into a slacked state. At this time, the vehicle to be detected starts, the wheels except the front wheels of the vehicle press the crank plate 10 so that they enter into the pressing plates 3. As a result, each crank plate 10 will flush with the surfaces of the left platform 7-1 and right platform 7-2 in the horizontal direction as shown in FIG. 1. Thus, the vehicle to be detected can be stably driven away from fixed descending slops at the bank.

Although a preferred embodiment has been shown and described, it would be appreciated by those skilled in the art that changes may be made in these embodiments without departing from the principles and spirit of the invention, the scope of which is defined in the claims and their equivalents.

What is claimed is:

1. A reversible plate positioning device for a stationary radiation imaging trailer system, comprising a left platform (7-1) and a right platform (7-2) that can be connected with a trailing part (4) of a trailer frame and a ground locking part (12), the left platform (7-1) and right platform (7-2) being provided at the front ends thereof with slopes (1) for the uploading of a vehicle to be detected respectively and at the middle of an upper surface with positioning recesses (9), each positioning recess (9) being provided with a wheel-locking device (2), wherein:

each wheel-locking device (2) comprises:

a pivotable crank plate (10) which is hinged to the respective positioning recess (9) and can rotate about a pivot axis thereof;

a chain (15) connected with the crank plate (10);

a pull-rod (14) connected with the chain (15), and a fixing sleeve (6) corresponding to the pullrod (14), wherein:

a spring (13) is provided in the fixing sleeve (6), and when the vehicle to be detected is located in the positioning recesses (9), each crank plate (10) rotates around the pivot axis thereof due to the elastic force of the spring (13) so that the crank plate (10) is brought into a lifted-up state at the front portion of each positioning recess (9), thereby wheels of the vehicle are locked in the positioning recesses (9), a carrier rod (5) capable of compressing the spring (13) is respectively provided at an end of each fixing sleeve (6), and when a trailer is landed at a bank, the carrier rods (5) compress the springs (13) due to external force, so that each crank plate (10) is brought into a slacked state due to operation of the pullrod (14).

2. The reversible plate positioning device for a stationary radiation imaging trailer system according to claim 1, wherein:

each crank plate (10) is hinged to a side plate of a rib plate (16) at a bottom side end of each positioning recesses (9) so as to be rotatable around the pivot axis thereof.

3. The reversible plate positioning device for a stationary radiation imaging trailer system according to claim 1, wherein:

each fixing sleeve (6) is provided at the bottom parts of the left and right platforms (7-1, 7-2) at rear ends of each positioning recess (9) respectively.

4. The reversible plate positioning device for a stationary radiation imaging trailer system according to claim 1, wherein:

each pull-rod (14) is extended into each fixing sleeve (6) respectively and is tightened by the spring (13) provided in the fixing sleeve (6), 50 that each crank plate (10) is brought into a lifted-up position at the front part of each positioning recess (9).

5. The reversible plate positioning device for a stationary radiation imaging trailer system according to claim 1, wherein:

each crank plate (10) can rotate around the pivot axis thereof so that an upper end face of the crank plate (10) can enter into the left and right platforms (71, 72).

6. The reversible plate positioning device for a stationary radiation imaging trailer system according to claim 1, wherein:

a rear part of each positioning recess (9) is provided with a sloping plate (8) for performing a cushion effect.

7. The reversible plate positioning device for a stationary radiation imaging trailer system according to claim 1, wherein:

each positioning recess (9) has a size that matches with that of the lower part of the wheels in the vehicle to be detected.

8. The reversible plate positioning device for a stationary radiation imaging trailer system according to claim 7, wherein:

a rear part of each positioning recess (9) is provided with a sloping plate (8) for performing a cushion effect.

9. The reversible plate positioning device for a stationary radiation imaging trailer system according to claim 1, wherein:

an upper end face of each crank plate (10) is uniformly arranged with rivets (11) for prevention of slipping.

10. The reversible plate positioning device for a stationary radiation imaging trailer system according to claim 8, wherein:

an upper end face of each crank plate (10) is uniformly arranged with rivets (11) for prevention of slipping.

11. A stationary radiation imaging trailer system, comprising a reversible plate positioning device according to claim 1.

12. A stationary radiation imaging inspection system, comprising the stationary radiation imaging trailer system according to claim 11.

* * * * *